US006932120B2

(12) United States Patent
Busskamp et al.

(10) Patent No.: US 6,932,120 B2
(45) Date of Patent: Aug. 23, 2005

(54) METHOD FOR PRODUCING AIRBAGS

(75) Inventors: Heinz Busskamp, Rheinfelden (DE); Michael Becker, Zell im Wiesental (DE); Thomas Eschbach, Rheinheim (DE); Norbert Huber, Bad Säckingen (DE)

(73) Assignee: Berger Seiba-Technotex Verwaltungs GmbH & Co., Bad Säckingen (DE)

( * ) Notice: Subject to any disclaimer, the term of this patent is extended or adjusted under 35 U.S.C. 154(b) by 0 days.

(21) Appl. No.: 10/784,407

(22) Filed: Feb. 23, 2004

(65) Prior Publication Data

US 2004/0200540 A1 Oct. 14, 2004

Related U.S. Application Data

(63) Continuation of application No. PCT/EP02/10851, filed on Sep. 27, 2002.

(30) Foreign Application Priority Data

Sep. 27, 2001 (DE) ..... 101 47 641

(51) Int. Cl.[7] ..... D04H 13/00

(52) U.S. Cl. ..... 139/426 R; 139/420 A; 235/462.01; 83/56; 83/107; 28/107; 28/110

(58) Field of Search ..... 139/420 A, 426 R; 235/462.01; 83/13, 56, 107; 28/107, 110

(56) References Cited

U.S. PATENT DOCUMENTS

| | | | | | |
|---|---|---|---|---|---|
| 3,839,637 | A | | 10/1974 | Willis | |
| 4,178,820 | A | * | 12/1979 | Gerber | 83/13 |
| 4,401,001 | A | * | 8/1983 | Gerber et al. | 83/451 |
| 4,596,171 | A | * | 6/1986 | Gerber | 83/56 |
| 4,766,301 | A | | 8/1988 | Evers | |
| 5,349,728 | A | * | 9/1994 | Murakami et al. | 28/107 |
| 5,454,594 | A | | 10/1995 | Krickl | |
| 6,123,117 | A | * | 9/2000 | Borellini | 139/420 A |
| 6,663,005 | B2 | * | 12/2003 | Tischer | 235/462.01 |

FOREIGN PATENT DOCUMENTS

| | | |
|---|---|---|
| DE | 34 39 373 A1 | 5/1986 |
| DE | 36 27 315 A1 | 2/1987 |
| DE | 43 14 347 A1 | 11/1994 |
| JP | 61-47801 | 3/1986 |
| JP | 8-60540 | 3/1996 |

OTHER PUBLICATIONS

Patent Abstract in English of Japanese Publication No. 2000153742 published Jun. 6, 2000.

* cited by examiner

*Primary Examiner*—John J. Calvert
*Assistant Examiner*—Robert H. Muromoto, Jr.
(74) *Attorney, Agent, or Firm*—Harness, Dickey & Pierce, P.L.C.

(57) ABSTRACT

A method for producing woven airbags, especially at least partially multi-layered airbags, includes the following steps: the warp threads are prepared in a warping room, warp threads which are suitable as marker threads for machine-readable markings being already placed in the warp; the airbag material is woven, weft threads which are suitable as marker threads for machine-readable markings being interlaced over at least part of the width of the cloth; and the airbag is cut out of the airbag material using a cutting device which is guided by the interlaced machine-readable markings.

19 Claims, 1 Drawing Sheet

METHOD FOR PRODUCING AIRBAGS

CROSS REFERENCE TO RELATED APPLICATIONS

This application is a continuation of PCT/EP02/10851, filed Sep. 27, 2002, which claims priority to German Application No. 101 47 641.8, filed Sep. 27, 2001, which are incorporated by reference herein.

BACKGROUND AND SUMMARY OF THE INVENTION

The present invention relates to a method for producing woven air bags, particularly multi-ply at least in part, as well as to a fabric, particularly for air bags multi-ply in part.

After weaving, fabrics, especially for partly multi-ply air bags, are as a rule cut to size on patterning tables. Air bags configured multi-ply in part as woven in once piece on weaving machines are termed "one-piece-woven" (OPW) air bags. The ply and contour of the OPW air bag in the web of fabric coming from the weaving machine are intended as specifications for a cutting system.

Air bag fabrics currently employed, especially for OPW air bags, including air bags woven multi-ply contoured make it very difficult to adapt an action to the discrete contour of the air bag in the fabric. Although for the sake of simplicity the term OPW is used throughout the following description, it is understood that this includes air bag fabrics, woven air bags and OPW air bags. The woven single-ply contour hardly stands out, for example, from woven two-ply portions, resulting in it failing to be reliably "seen" by automatic sensing systems.

In OPW patterning this poses the following problems. In current air bag fabric patterning systems single or sets of blanks materialize as follows: from cutting system specifications for dimensioning discrete parts a program sequence is generated manually or automatically e.g. via a CAD program for a CNC cutter, for example, which describes how the discrete parts are to be cut from the air bag fabric. Cutting is done irrespective of the status of the fabric each time, i.e. the cutter moves relative to a fiducial of the cutting system no matter how and where the fabric is actually located in the system. This means that any deviations in the fabric, especially as regards dimensions of the OPW fail to be automatically taken into account or corrections make manually intervention in the program sequence necessary. This, as a rule, involves halting the machine with serious disadvantages in time and money in making the correction and possibly resulting in a high percentage of rejects in continuation of the program (possibly incorrect). This is why, especially with OPW air bags the reject percentage is high because of deviations dimensionally in the various parts of the fabric as is especially the case with articles having extremely critical contours due to the weaving contour being infringed or nicks in the air bag chamber or the tolerances of the cutting edge relative to the woven contours being exceeded or fallen short of.

In the online gaging systems as used in the aforementioned patterning systems, implementing gaging on unblanked OPWs in the air bag fabric at defined locations lacks reliability because the woven contours cannot be reliably sensed. Establishing the values necessitates manual gaging at considerable cost and manual expenditure.

The present invention is based on the objective of proposing a method for producing air bags woven particularly multi-ply at least in part, as well as a fabric, in avoiding or at least greatly diminishing the disadvantages of prior art. This objective is achieved, for one thing, by a method as it reads from claim 1 and, for another, by a fabric as it reads from claim 2. The method in accordance with the invention comprises the following steps:

a) preparing the warp threads in the warping shop so that warp threads suitable as machine-readable marker threads are already included in the warp, b) weaving the air bag fabric so that weft threads suitable as machine readable marker threads are included in the weave of at least part of the cloth width, c) cutting out the air bag from the air bag fabric by means of a cutter guided by said machine-readable threads included in the weave.

This method has the major advantage that the incorporated markers now ensure that the resulting fiducials in the fabric are machine-readable and always reliably attained in the subsequent steps in the process. This method permitting any desired position and number of markers now makes it possible to correct any deviations in contour and dimensions in and between the discrete air bags located in the woven web on patterning and in addition to reliably place fiducials in subsequent steps in the process, now irrespective of the fact that a textile is live and each variation of the air bag makes for different requirements.

The fabric in accordance with the invention, especially for air bags woven multi-ply in part, is characterized by machine-readable markers for sensing specific portions of the fabric. In this arrangement the markers, for example single or multiple threads differing in color, structure, material or in some other way from the air bag fabric as so-called marker threads or other linear or non-linear or dotted markers are included in the weave or otherwise incorporated before, during or after the weaving process. These marker threads or markers now make it possible to advantage via defined wanted spacings to each other and the defined wanted arrangement relative to a OPW in conjunction with each of the actual spacings and actual arrangement to gage the shape and/or size and/or orientation or distortion of the patterned OPW or OPW in the uncut air bag fabric or of the blank following cutting in subsequent steps in the method. Further advantages and features of the invention read from the sub-claims.

BRIEF DESCRIPTION OF THE DRAWINGS

Two example embodiments of the fabric in accordance with the invention will now be detailed with reference to the drawing in which.

DETAILED DESCRIPTION

The invention will now be described by way of an example in producing an OPW. In preparing the warp threads in the warping shop, warp threads suitable as machine-readable marker threads are already included in the warp. In weaving the air bag fabric weft threads suitable as machine readable marker threads are included in the weave of at least part of the cloth width. In subsequent cutting out the air bag from the air bag fabric by means of a cutting system, the cutter is guided by said machine-readable marker threads included in the weave.

Before or during cutting the actual positions of these threads or markers are "seen" in a suitable system and compared to the wanted positions stored in a program sequence for cutting OPW or air bag parts and the differences used in automatically adapting the cutting program (e.g. re-sizing). This now eliminates costly manual intervention, automatic adaption permitting production to extremely tight tolerances as well as extremely critical contours. Deviations in dimension within a woven item or between discrete woven items can be taken into account before or during the cutting process in thus substantially reducing the percentage of rejects due to contour infringements.

The invention will now be described by way of an example in detailling dimension sensing. Gaging the OPW, uncut in the air bag fabric or during or after cutting formerly necessitating highly intensive labor can now be done automatically. The marker threads or markers standing out from the OPW or air bag material can be sensed by a sensor system and the status of the OPW as regards shape and/or size and/or orientation and/or distortion detected via the arrangement of the marker threads or markers. The results as to the article in each case permits conclusions as to the status of the OPW in each case.

Figure 1:
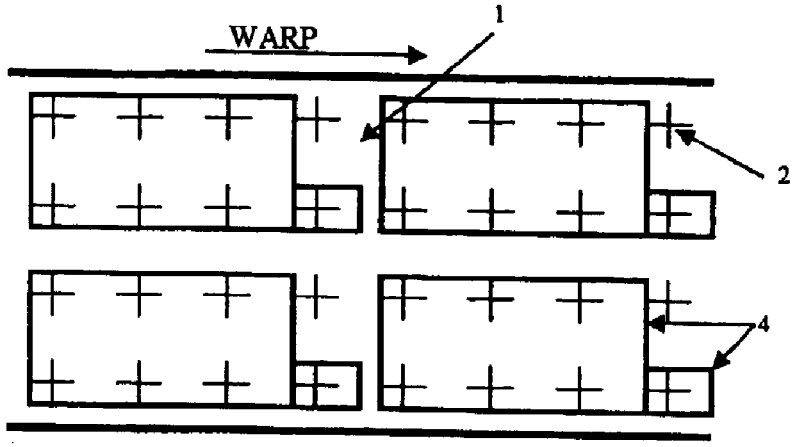
FIG. 1 is a diagrammatic fabric section showing printed markers.
Figure 2:
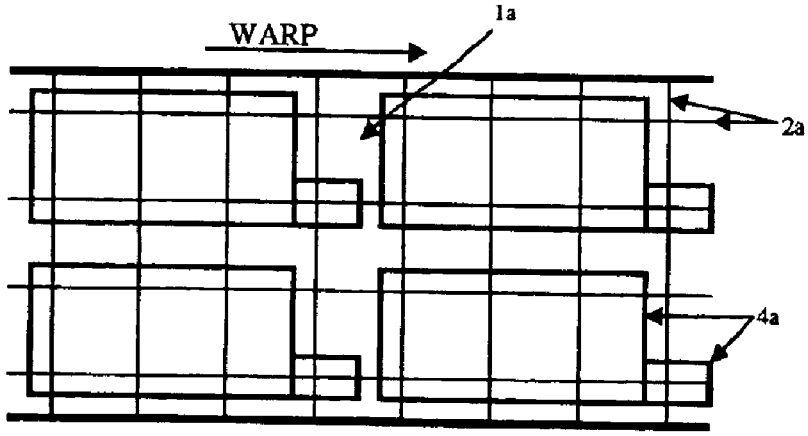
FIG. 2 is a diagrammatic fabric section showing woven markers.

Two variants of markers are shown in the example embodiments. Referring now to FIG. 1 there is illustrated an OPW fabric 1 with printed markers 2 adapted to the woven contour 4. Referring now to FIG. 2 there is illustrated an OPW fabric 1*a* in which marker threads 2*a* differing from the basic material are included before or during weaving and adapted to the woven contours 4*a*. The markers applied to or included in the fabric or woven contour of an OPW before, during or following weaving, e.g. by printing or by marker threads, serve to adapt subsequent processes to the woven contour or the fabric as fiducials, particularly for sensing woven contours of the OPW and subsequent correction of the following steps in the process.

What is claimed:

1. A method of producing woven air bags, more particularly configured multi-ply in part, comprising the steps:

a) preparing the warp threads in the warping shop so that warp threads suitable as machine-readable markers are already included in the warp, b) weaving the air bag fabric so that weft threads suitable as machine-readable markers are included in the weave of at least part of the cloth width, c) cutting out the air bag from the air bag fabric guided by said machine-readable markers included in the weave, and d) performing said cutting regardless of the fabric positioning immediately prior to said cutting.

2. The method of claim 1, whereas colored warp and weft threads are included in the weave.

3. The method of claim 1, whereas conductive warp and weft threads are included in the weave.

4. The method of claim 1, further comprising making a one-piece-woven airbag.

5. The method of claim 1, further comprising automatically varying said cutting based at least in part on said machine-readable markers.

6. The method of claim 1, further comprising printing said machine-readable markers onto a contoured surface of the airbag fabric.

7. The method of claim 1, wherein the threads that define the machine-readable markers are of a different material than those of the remainder of airbag fabric.

8. A method of manufacturing an inflatable safety device, the method comprising:

a) creating a fiducial indication on at least one thread;

b) weaving together multiple threads, c) automatically varying a cutting action of the woven threads based, at least in part, on the fiducial indication, and d) adapting the cutting to account for deviations in dimensions of the woven threads.

9. The method of claim 8, further comprising creating an airbag from the woven threads.

10. The method of claim 8, further comprising creating a multi-ply safety device.

11. The method of claim 8, further comprising printing the fiducial indications onto a contoured surface of the woven threads.

12. The method of claim 8, wherein the threads with the fiducial indication is of a different material than the remainder of the woven threads.

13. The method of claim 8, further comprising making a one-piece-woven airbag with multiples of the fiducial indication extending in differing directions.

14. The method of claim 8, wherein the weaving step occurs after the creating step.

15. A method of producing woven air bags, more particularly configured multi-ply in part, comprising the steps:

a) preparing the warp threads in the warping shop so that warp threads suitable as machine-readable markers are already included in the warp, b) weaving the air bag fabric so that weft threads suitable as machine-readable markers are included in the weave of at least part of the cloth width, c) cutting out the air bag from the air bag fabric guided by said machine-readable markers included in the weave, and d) adapting said cutting to account for deviations in dimensions of the airbag fabric.

16. The method of claim 15, further comprising making a one-piece-woven airbag.

17. The method of claim 15, further comprising automatically varying said cutting based at least in part on said machine-readable markers.

18. The method of claim 15, further comprising printing said machine-readable markers onto a contoured surface of the airbag fabric.

19. The method of claim 15, wherein the threads that define the machine-readable markers are of a different material than those of the remainder of airbag fabric.

* * * * *